US006820375B2

(12) United States Patent
Meeker

(10) Patent No.: US 6,820,375 B2
(45) Date of Patent: Nov. 23, 2004

(54) PRECUT UTILITY CORE FOR SMALL BUILDING STRUCTURES

(76) Inventor: Martha C. Meeker, 4902 Mallard View Dr., Indianapolis, IN (US) 46226

( * ) Notice: Subject to any disclaimer, the term of this patent is extended or adjusted under 35 U.S.C. 154(b) by 0 days.

(21) Appl. No.: 10/414,687

(22) Filed: Apr. 16, 2003

(65) Prior Publication Data

US 2004/0206011 A1 Oct. 21, 2004

(51) Int. Cl.[7] ..... E04H 1/00
(52) U.S. Cl. ..... 52/36.1; 52/34; 52/79.1
(58) Field of Search ..... 52/36.1, 34, 79.4, 52/79.1, 35, 32, 65; 4/663

(56) References Cited

U.S. PATENT DOCUMENTS 2,419,319 A * 4/1947 Lankton ..... 52/27
3,762,112 A * 10/1973 Evans et al. ..... 52/79.8
4,341,052 A * 7/1982 Douglass, Jr. ..... 52/741.11
4,544,214 A * 10/1985 Nizel et al. ..... 312/209
4,612,741 A * 9/1986 Jacobson ..... 52/79.4
4,655,011 A * 4/1987 Borges ..... 52/79.1
5,737,895 A * 4/1998 Perrin ..... 52/745.1
6,651,393 B2 * 11/2003 Don et al. ..... 52/79.5
2002/0104271 A1 * 8/2002 Gallant ..... 52/36.1
2003/0024713 A1 * 2/2003 Han et al. ..... 173/89

* cited by examiner

*Primary Examiner*—Peter M. Cuomo
*Assistant Examiner*—Stephanie Harris
(74) *Attorney, Agent, or Firm*—Woodard, Emhardt, Moriarty, McNett & Henry LLP

(57) ABSTRACT

A precut utility core for centrally locating all utility lines to be connected to appliances located in areas surrounding the core. The core consists of an inner cage housing with utility lines, a plurality of structural walls extending outwardly therefrom forming areas that house bath and kitchen appliances. An outer cage surrounds and partially encloses the inner cage. The structural walls are connected together to the outer cage. The precut utility core additionally is designed to support an optional upward extending rain-gathering funnel shaped tank capable of furnishing rainwater by gravity to the core.

17 Claims, 7 Drawing Sheets

PRECUT UTILITY CORE FOR SMALL BUILDING STRUCTURES

BACKGROUND OF THE INVENTION

The present invention relates generally to the field of precut building structures providing a centralized area for locating utility lines for connecting to appliances provided in rooms radiating outwardly from the utility storage area.

DESCRIPTION OF THE PRIOR ART

With the dwindling availability of fresh water, clean air and other resources, such as coal, oil and lumber, along with the ever increasing number of people inhabiting this planet requiring more energy and mobility; thereby, creating more pollution, as well as requiring more housing, over and above housing replacement and housing losses due to war and natural disasters, there is a need to incorporate into a precut shippable utility core, for installation into new or existing small structures, all the environmentally correct and resource friendly utilities and appliances. No dwelling should be constructed without thought to conserving water and utilizing renewable resources to the fullest. Thus, it is desirable to retrofit existing housing with rainwater collectors and cisterns for the gathering and storage of rainwater.

Although there have been many types of residential utility cores on the market over the years, most were designed as raw plumbing to be installed within a standard existing room wall or were incorporated into the construction of the original room wall. Many of the prior cores incorporated existing heat/air and hot water units, pipes, ducts, and fixtures. Some cores were complete utility rooms, bathrooms or kitchens, and all were prefabricated offering few options. Therefore, each core had to be hauled to the site on a specific timetable to be installed during construction of the building. All cores were too large to be easily installed in existing buildings. None are known to be specifically designed to house, if desired, state of the art environmentally safe and resource friendly utilities or designed as a complete precut residential utility core, capable of being shipped with customized utilities, appliances and fixtures to meet requirements of any given location and assembled on site in new construction or existing buildings.

My invention is designed to provide a bathroom/kitchen to small structures whether the location provides municipal water, electricity and sanitary sewers or is installed in housing in third world countries where none of those services are provided.

A number of U.S. patents have been granted on various combinations of prefabricated units arranged to be placed within the building walls. For example, the U.S. Pat. No. 3,381,313 discloses a pre-fabricated module that includes utilities. The U.S. Pat. Nos. 2,653,357 and 4,655,011 locate the plumbing along with fixtures in the complete rooms to be shipped to the site. The U.S. Pat. No. 4,612,741 discloses a generally circular arrangement with multiple compartments surrounding the central utility core for sewer, water, gas or electrical hook-ups. Likewise, the published Patent Application US02/0116879A1 discloses multiple compartments arranged around a central core designed to contain duct work, conduit, vents, pipes and other utility apparatus. The U.S. Pat. No. 3,152,366 discloses a modular unit which may be fabricated at a remote site.

SUMMARY OF THE INVENTION

One embodiment of the present invention is a modular utility core for shipping in a disassembled state to a building site for use and then being assembled atop a floor. The core includes a rigid outer cage with outer cage bottom ends. Outer cage mounting fittings on the outer cage bottom ends fixedly mount the leveled and shimmed outer cage to the floor. A utility channel inner cage is provided within the outer cage. A plurality of structural walls are connected to and extended outwardly from the inner cage toward and are connected to the outer cage forming rooms including a bathroom. The outer cage and the inner cage further include a kitchen located outwardly of the outer cage with the bathroom and kitchen each including appliances/fixtures located between the outer cage and the inner cage and between the walls for controlling flow of fresh water and sewage water. Fresh water conveying conduits are within the inner cage and are connected to the appliances/fixtures in the bathroom and kitchen. Vent conduits within the inner cage are connected to sewage water conveying conduits allowing outward venting thereof.

It is an object of the present invention to provide a precut utility core for installation into small building structures.

A further object of the present invention is to provide a construction centrally locating various utilities with rooms provided therearound and extending radially therefrom.

A further object of the present invention is to provide a condensed arrangement of rooms positioned around a central utility core minimizing the cost of construction.

A further object of this invention is to provide a utility core which can be retrofitted and customized.

Related objects and advantages of the present invention will be apparent from the following description.

DESCRIPTION OF THE PREFERRED EMBODIMENT

Figure 1:
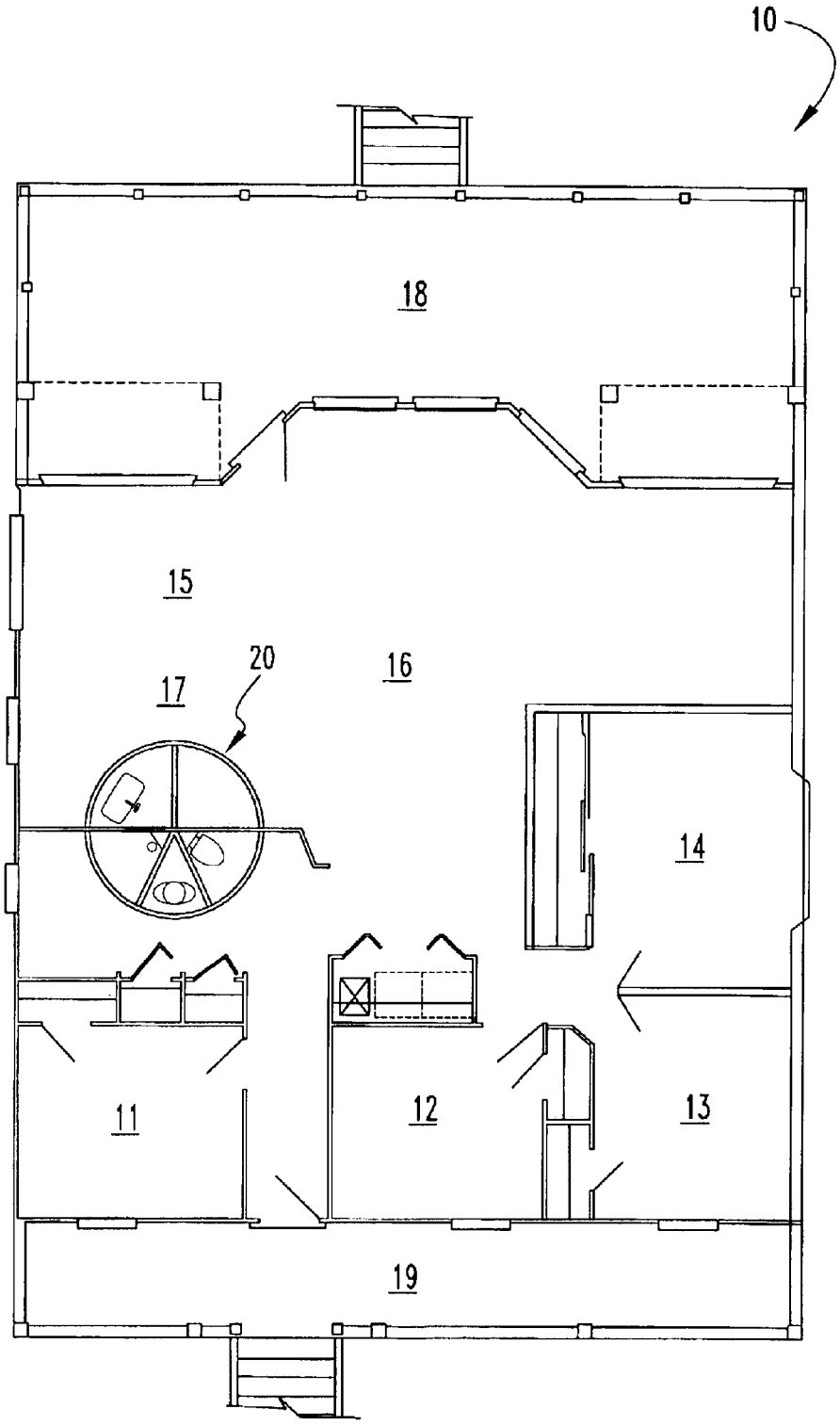
FIG. 1 is a floor plan of a building incorporating the utility core of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a floor plan of a house that incorporates the utility core of the present invention. The house or building 10 includes four bedrooms 11–14, a dining area 15, a living area 16, a kitchen area 17, a deck 18 and porch 19. The utility core 20 is located within the building for the purpose of centralizing the water, sewage, electric, communication lines, and other incoming and outgoing utility lines. Various rooms and appliances are positioned around the utility core thereby eliminating the necessity for routing the various utility lines to different areas within the building.

Figure 8:
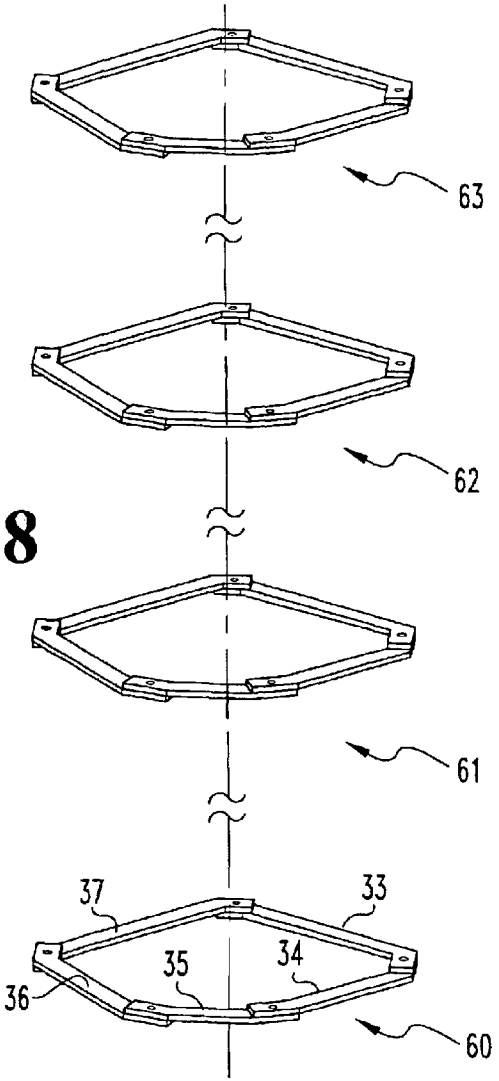
FIG. 8 is a side view illustrating the bands of plates forming the inner cage.

The utility core 20 (FIG. 2) consists of an outer cage 30 surrounding an inner cage 31 which is assembled on site directly over the utility access located within the structure slab. The various utility lines are thereby located within the inner cage 31 which is formed by a plurality of plates inner-connected together and positioned in four vertically spaced apart bands 60–63(FIG. 8). The plates are connected to structural walls 38–42 radiating outwardly therefrom to the outer cage.

The plates are arranged to form the plurality of bands spaced apart vertically along the length of the utility cage. For example, four such bands 60–63 are depicted in FIG. 8 being spaced apart vertically and connected to the structural walls extending radially therefrom. The bands are connected to the structural walls and not directly to each other.

Figure 2:
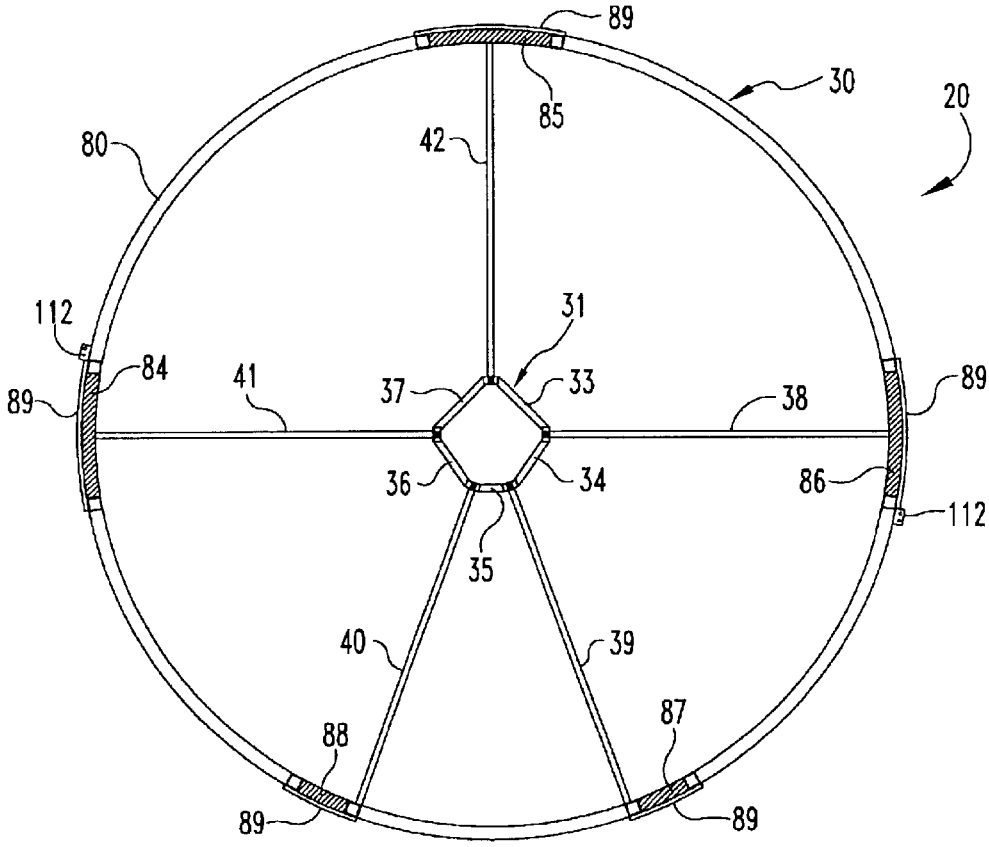
FIG. 2 is a bottom plan view of the utility core.
Figure 5:
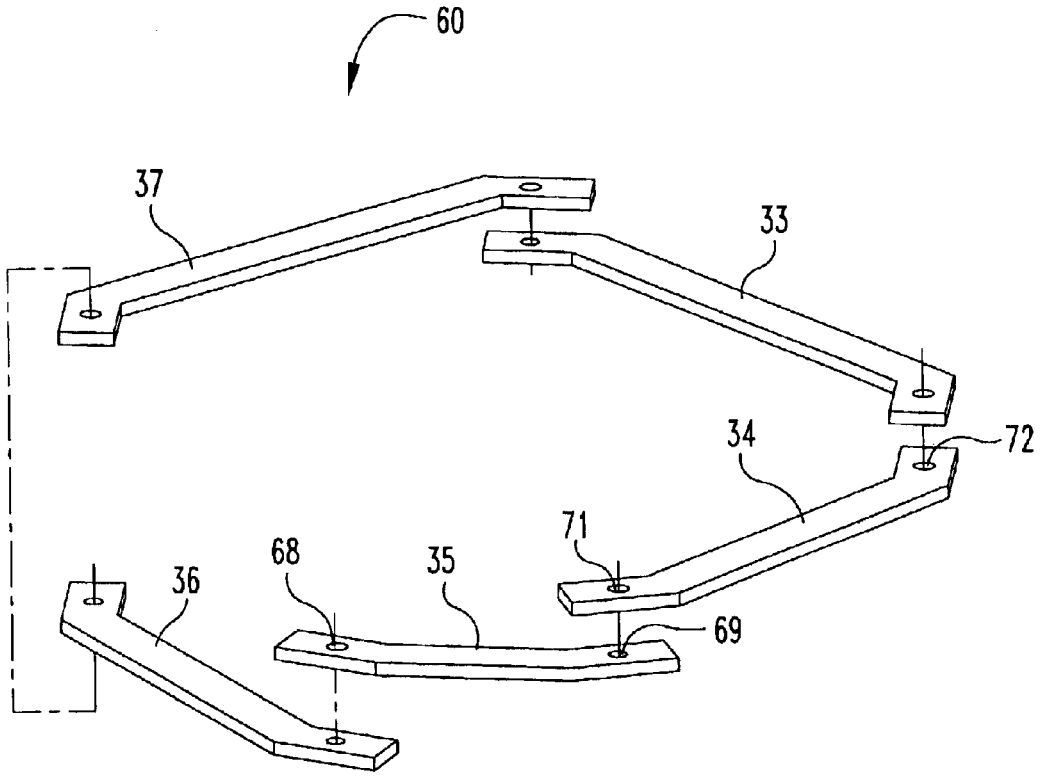
FIG. 5 is an exploded perspective view of five plates connected together forming a band for the inner cage.
Figure 4:
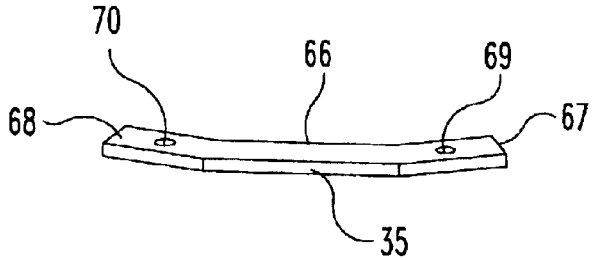
FIG. 4 is a perspective view of a typical plate used in constructing the inner cage.

Band 60 will now be described it being understood that a similar description applies to bands 61–63. Band 60 consists, in the embodiment shown in the drawings, of five separate plates 33–37 (FIG. 5). Each plate consists of a straight main body with a pair of inwardly turned ends. For example, plate 35 (FIG. 4) has a straight main body 66 with a pair of inwardly turned ends 67 and 68. A pair of holes 69 and 70 extend through the opposite ends to receive the threaded prongs of the structural walls 38–42(FIG. 2). A similar description applies to plates 33, 34, 36, 37.

Figure 3:
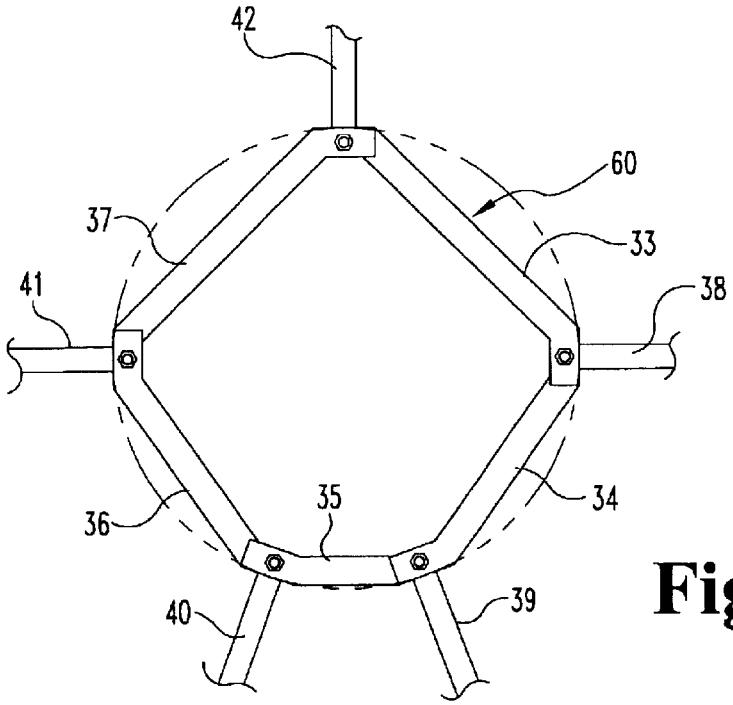
FIG. 3 is an enlarged plan view depicting the connection of the outwardly extending walls to the inner cage.

In order to assemble band 60, plates 33–37 are arranged in a circular fashion with the end of one plate overlapping the end of an adjacent plate. Thus, the right end of plate 35 as viewed in FIG. 8 is positioned beneath the left end of plate 34 whereas the right end of plate 34 is positioned beneath the left end of plate 33 and continuing in similar fashion until the right end of plate 36 is located beneath plate 35. The threaded prongs 121 (FIG. 9) of the structural walls are inserted through the holes of the adjacent ends of the plates thereby securing the walls and plates together. A conventional internally threaded nut 122 is then secured to the threaded prong holding the plates in position. In the preferred embodiment, the plates are sized when connected together to fit within a 12 inch diameter circle (FIG. 3).

The plurality of structural walls 38–42 extend radially outward from each band. For example, walls 38–42 (FIG. 2) extend radially outward from band 60. The inner end of each structural wall includes four inwardly extending identical flanges each with an upwardly turned threaded prong. The prong extends through the holes in the plates. One such flange and prong will now be described it being understood that a similar description applies to the other three flanges and prongs. Flange 120(FIG. 9) has an upwardly turned and threaded prong 121 that extends through holes 69 and 71(FIG. 5) of respective plates 35 and 34. A conventional nut 122 is threaded onto the fastener 121 securing plates 35 and 34 and wall 39 together. Plate 35 is positioned beneath plate 34 when receiving prong 121.

Plates 35 and 34 along with plates 33, 36 and 37 are located in band 60(FIG. 8) which is the lowest positioned band. Three identical bands 61, 62 and 63 are located vertically above and aligned with band 60. Bands 61–63 each include five separate plates that are arranged in the manner described for band 60. That is, the opposite ends of the plates overlap and are provided with holes through which the prongs on the adjacent structural wall extend. The inner end (FIG. 9) of each wall 38–42 includes four separate and vertically spaced apart flanges each of which includes an upwardly turned and threaded prong to extend through the holes in the overlapping ends of the plates in each of the bands 60–63.

A particular advantage of the construction of the inner cages is that it allows for the use of different lengths and numbers of plates depending upon the number and sizes of rooms to surround the inner cage. In the embodiment in FIG. 2, a total of five plates are used for each band thereby creating five separate areas. By the addition of one wall and an additional plate to each band totaling six plates for each band, the areas are increased by one to six such areas.

The structural walls 3842 of the inner cage (FIG. 2), (FIG. 7), (FIG. 10), each consist of a rectangular frame with two vertical members and a plurality of horizontal members, affixed and suitably braced between top and bottom frame members. Structural wall 38 will now be described it being understood that a similar description applies to walls 3942. Wall 38 has two vertical members 150 and 151 (FIG. 10) joined to four horizontal members 152, 153, 154 and 155. The vertical members 150 and 151 have means recessed on the front and back sides extending top to bottom to accept and support the overhead cabinets countertops and appliances located within and between the walls. The means additionally accepts skins to cover the front and rear wall surfaces when required. The means includes, for example, holes to receive hooks attached to the cabinets, countertops, appliances and skins. The walls additionally each consist of a recessed channel along the top edge of the top horizontal frame member 155 (FIG. 10) to accept upwardly extending rain-gathering funnel shaped tank support members 96–99 (FIG. 10) when an optional funnel shaped tank 95 is attached upwardly therefrom. An additional support member is mounted to wall 42.

Figure 9:
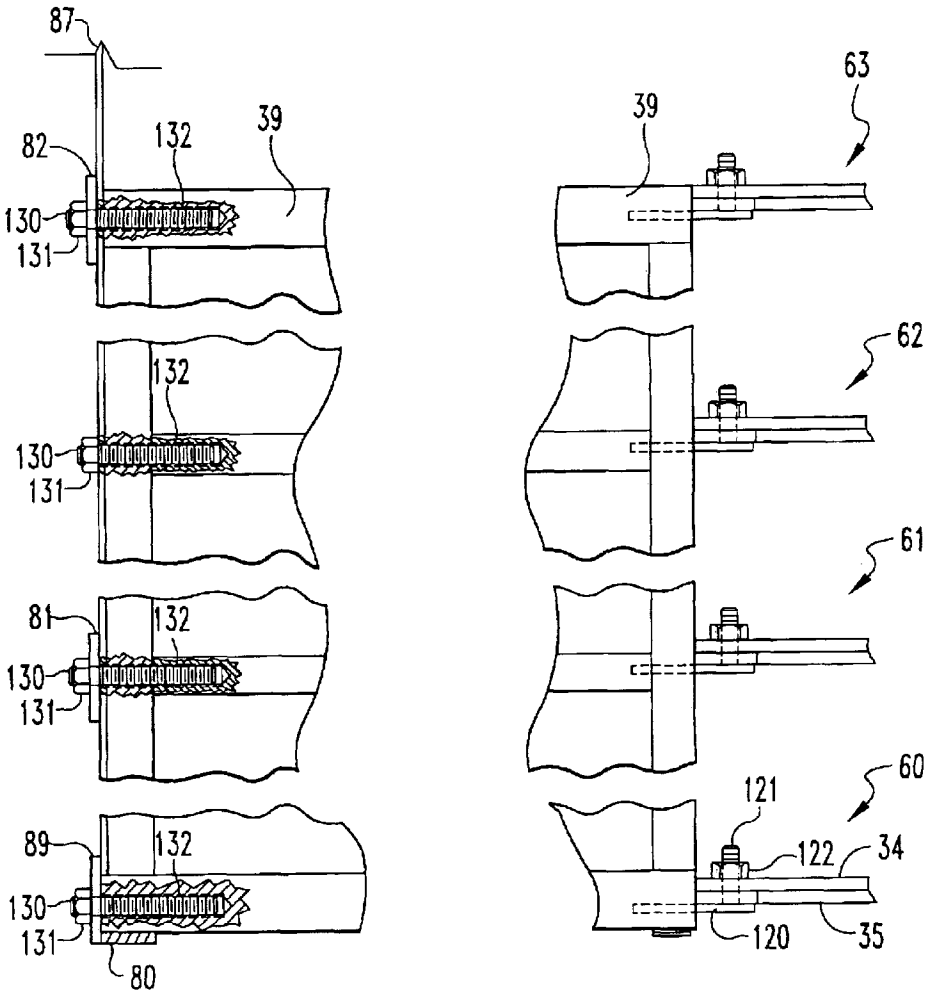
FIG. 9 is a fragmentary side of the inner end view of structural wall 39 connected to the plates forming the inner cage and a fragmentary side view of the outer end of wall 39 connected to the outer cage vertical member 87 and horizontal rings 80–82.
Figure 10:
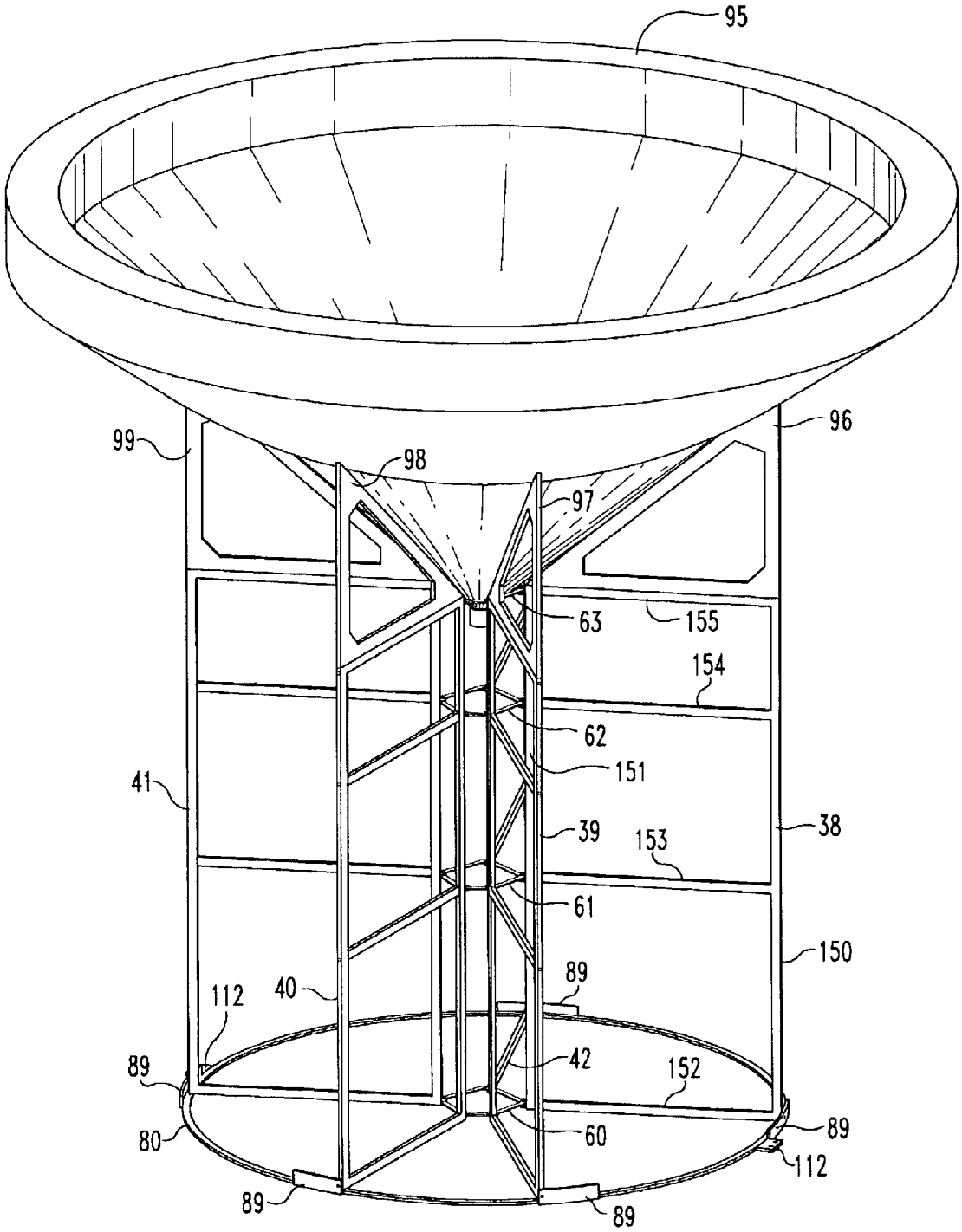
FIG. 10 is a perspective view of the utility core with outer cage members removed with the exception of bottom ring 80 showing the structural walls with inner cage members attached inwardly and an optional upwardly extending rainwater gathering funnel shaped tank and tank support members installed thereatop.

The structural walls radiate outwardly from the inner cage to the outer cage positioning the outer edge of the bottom members 152 of the walls on the bottom ring 80 of the outer cage (FIG. 2) and (FIG. 10). The outer edge of the outer vertical frame members 150 of the structural walls 38–42 are secured to the outer cage at pre-drilled points 90 (FIG. 6) where the outer edges, outer cage vertical members 84–88 and rings 80, 81 and 82 intercept (FIG. 6) and are secured by threaded shanks 130 and nuts 131 (FIG. 9).

The outer cage 30 (FIG. 6) consists of a plurality of horizontally extending rings connected to a plurality of vertically extending members. Thus, outer cage 30 includes rings 80–83 connected to vertical members 84–88. Lower ring 80 is positioned horizontally and flat with upwardly extending outwardly positioned flanges 89 whereas rings 81, 82 and 83 are vertically positioned members. Rings 80, 82 and 83 are continuous whereas ring 81 is broken in two locations between members 86 and 87 and between members 84 and 88. Once the inner cage is connected to the structural walls inwardly and the outer cage lower rings 80–81 and vertical members 84–88 are in place, the outer cage rings 82 and 83 may be placed onto the outwardly ends of the structural walls and vertical cage members thereby forming the utility core. The structural walls are then attached to the outer cage.

Figure 6:
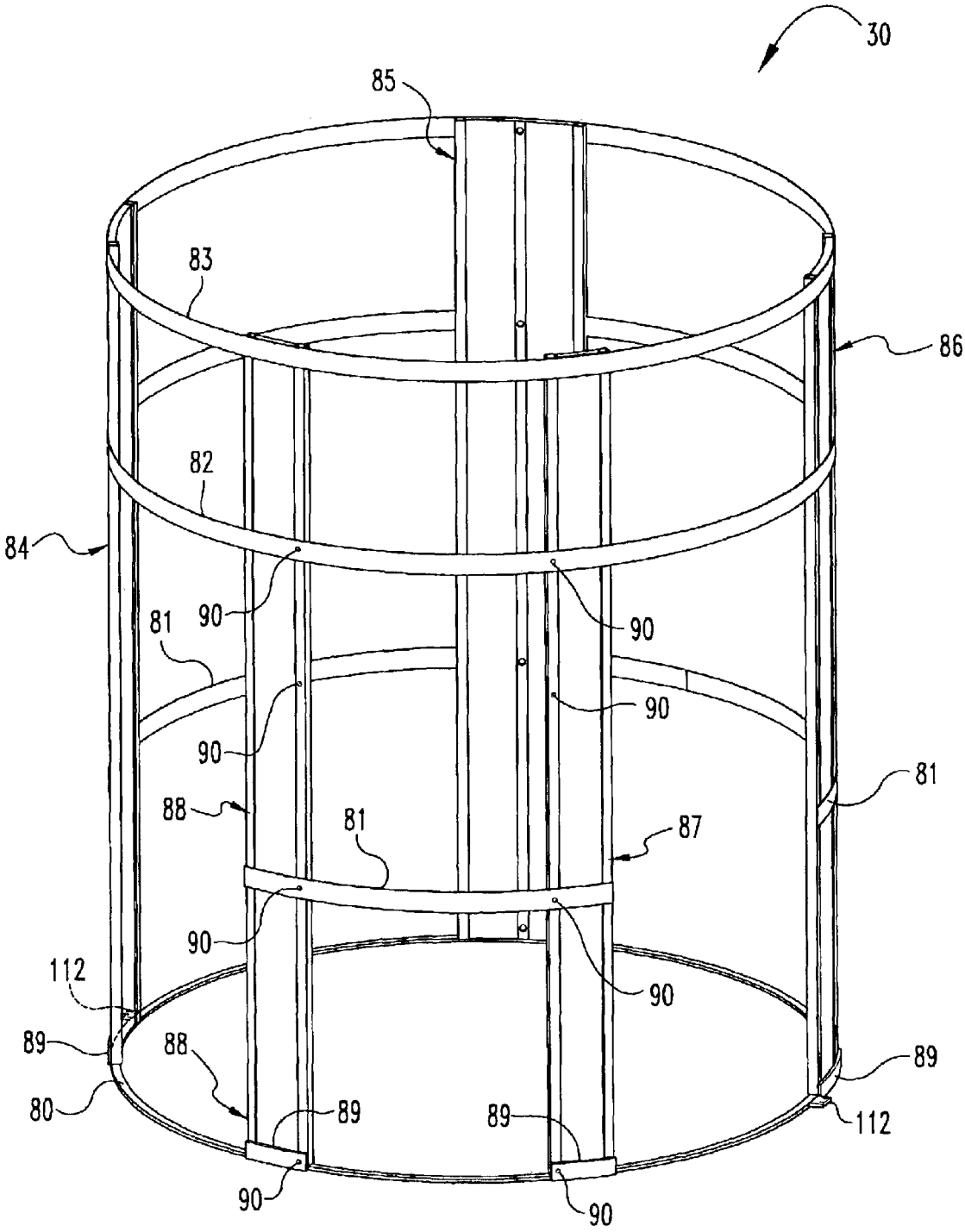
FIG. 6 is a perspective view of the outer cage.

To illustrate: The outer ends of walls 38–42 are secured to outer cage members 84–88 and rings 80–82 at points 90 (FIG. 6). For example, the outer end of wall 39(FIG. 9) has four threaded holes 132 receiving threaded shanks 130 that extend through holes 90 (FIG. 6) of member 87 and rings 80–82 and are secured therein by nuts 131.

Ring 80 (FIG. 6) is provided with upwardly extending flanges 89 where it intersects with the bottom ends of walls 38–42 and members 84–88 and is additionally provided with flanges 112 to affix to the floor by conventional fastening devices, such as, a bolt/nut combination.

Many variations are contemplated and included in the present invention. For example, an optional funnel shaped rainwater gathering tank 95 (FIG. 10) is available. Tank support and positioning members 96–99 and a support and position member mounted to wall 42 (not shown) are upwardly mounted at the bottom edge in a channel along the tops of the structural walls 38–42 and are shaped at the top edge to collectively form a cradle of support for the funnel being individually secured to upper ring 83 and vertical cage members 84–88. Funnel 95 opens outwardly through the roof of building 10 with the bottom end having an outlet connected to a water storage conduit located within the inner cage. A further variation includes the mounting of solar panels atop tank 95 with the solar panels being arranged across the width of the funnel shaped tank and being spaced apart to allow the rainwater to pass therebetween. The solar panels are connected to suitable energy storing devices located within the inner utility cage.

Ring 80 (FIG. 6) is located at floor level whereas ring 82 is located at structural wall height level and ring 83 is at ceiling height level. The height of the outer cage vertical members 84–88 can be customized and furnished for the core matching ceiling heights 8' to 8½' as required.

In the preferred embodiment there are five areas formed by the five structural walls 38–42 within the utility core (FIG. 2) and (FIG. 7) with some requiring an opaque finished surface or skin for the reason of privacy or decor and sound deadening insulation. Such would be walls 40 and 41 surrounding the toilet area; walls 38 and 39 require a skin on one side only and wall 42 is open thereby allowing the kitchen countertop to extend through it. No skin is required on the wall surfaces which surround the shower stall since it is a complete unit in itself.

Figure 7:
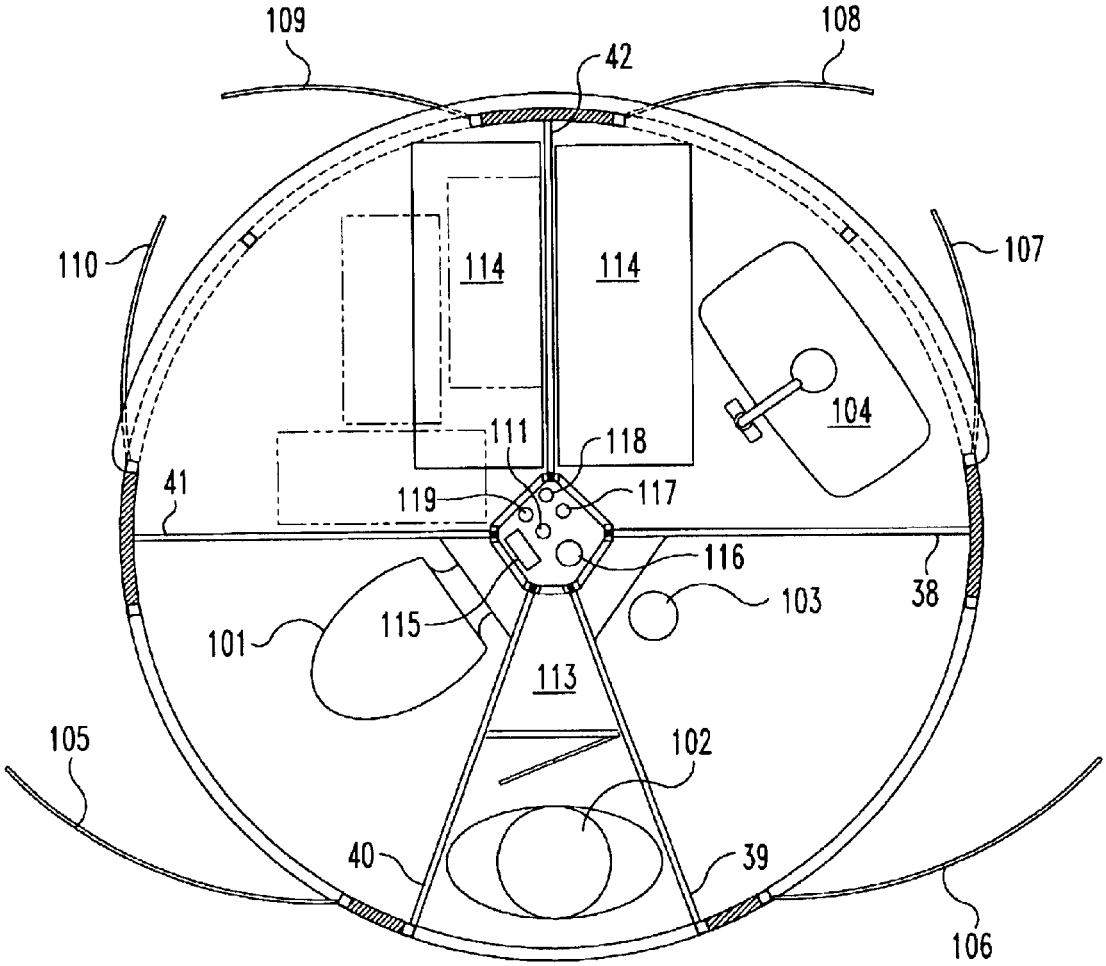
FIG. 7 is a plan view of the utility core of FIG. 2 with doors and illustrating the location of various appliances.

The various areas formed between the structural walls may be utilized for a variety of purposes. In FIG. 7, a commode 101 is located between walls 41 and 40 with an outer door 105 hingedly mounted to outer cage 30 to allow the area to be enclosed. A water basin 102 is mounted between walls 39 and 40. The space is suitably arranged so that doored cabinets may be positioned beneath the basin and with a suitable countertop surrounding the basin. A mirrored hinged door cabinet 113 is supported by the walls and is mounted over the basin. A shower stall cabinet 103 is provided between walls 38 and 39 with a door 106 hingedly mounted to the outer cage to enclose the shower area. The kitchen is formed by two areas, namely, the area between walls 38 and 42 and between walls 42 and 41. A sink 104 is provided in the area between walls 38 and 42 with a countertop and under counter cabinets with doors 107 and 108. A countertop and a variety of overhead cabinets 114 and appliances including a microwave, oven, and refrigerator may be provided in the areas enclosed by walls 38/42 and 42/41. A second pair of doors 109 and 110 are hingedly mounted to the outer cage to enclose the under counter cabinets between walls 42 and 41. All of the appliances 101–104 utilizing water are connected to a source of water located within the inner utility cage 31. Likewise, the same utilities are connected to the sewage disposal conduits located within the inner utility cage.

The core is environmentally and resource friendly capable of being retrofitted; thereby customized, to furnish housing for the plumbing, electrical and mechanical utilities, light and plumbing fixtures, cabinets and some appliances, as required, for use in new or existing small structures of various designs and materials found in diverse climates, cultures and with varying metropolitan utility services. The outer casing of the basic core is a cage constructed of braced vertical members, free standing and precut for assembly on site. The outer cage has a channel or inner cage located vertically and centrally within the outer cage to provide wire, duct, vent and pipe management, as well as, stabilization to inner structural walls. The frames for the structural walls attach to the channel cage and outer cage and have a channel along the top to accept a wall extension upwardly as well as fittings along the sides to attach cabinets and counter tops. The upward wall extensions to receive and support the optional upper section of the basic core if the optional upper section is required and installed. The outer cage of the basic utility core has height options, is open and fitted at the top to receive a cap or the upper section of the core if the optional upper section is required and installed. The upper section is a funnel shaped water storage tank with a flared top graduating down in size to fit into the top of the utility cage located centrally in the lower section of the utility core. The upper tank when in place is supported by upwardly extending tank support members of the structural walls and stabilized by vertical members of the outer cage of the utility and the encircling ring 83 at the top. The top of the tank of the upper section is installed through the roof to gather and store rainwater. The tank furnishes water by gravity to the basic core. Optionally available for installation in the top of the tank is a sloping cover, pipes for heating water and solar panels or photovoltaic roofing tiles.

The outer framework cage to be of any structural material, preferably aluminum or steel, precut and assembled on site. The members to be weight bearing to form a framework, cylindrical, polysided or square in plan, and approximately 8'–8½' in height; the height to be determined per ceiling height of structure into which it is to be installed and to include a poly-sided cage channel to be centrally positioned within for wire, duct, vent and pipe management. The bottom member of the outer cage has fittings for attachment to a stone, wood, brick or concrete slab or a specific custom foundation within a new or existing structure and can be shimmed for leveling the unit. The bottom of the centrally positioned utility channel cage has fittings, for use where required and available, for attaching the wired, ducted, vented and plumbed channel to a local electrical grid and to local water and sanitary sewer lines. A duct/vent 115, a water drain pipe 116, hot water pipe 117, cold water pipe 118, incoming water pipe 119, and an electrical conduit 111 (FIG. 7) are located within the inner cage and are connected to the appliances/fixtures located in the five rooms formed between the inner and outer cage. The core may be shipped with its optional upper section providing the housing unit with a water storage tank with which to collect and store rainwater, optional solar cells for the roof with storage batteries or a generator powered with ethanol for electrical power and an ultraviolet unit to purify rainwater for drinking. Such isolated housing is built in clusters with a common well for back-up water, a common biomass or other septic system, a common heat pump for room heating, a common cistern for the various water storage tanks overflow water and an ethanol powered generator for backup electrical power.

Items shipped with the utility core for installation for retrofitting into the core outer cage for a residential structure located in an area with all utilities available include: Fixtures and cabinets to include a low water-flush bowl with seat, overhead water tank and room door, that can be hinged left or right, with frame for toilet area; a wash basin, corner cosmetic cabinet with door mirror, counter top with the basin counter sunk and under basin cabinet with doors for lavatory area; a shower cabinet with shower head and door that may be hinged left or right with the frame for shower stall; two overhead wall hung kitchenette cabinets, one adjustable shelf, and two counter tops, one with inset laundry sized sink/tub and two under counter storage areas with doors. Two mobile kitchen/dining tables may be shipped with the basic unit as well as recessed light fixtures and track lighting for surrounding areas. Also shipped with the basic unit for placement in the area above the structural walls in the basic unit is a tankless water heater for all hot water faucets and a second hotter-set unit for hot water radiant heating of the unit and its surrounding area, if the latter is desired. If the optional upper section is required, the following additional items would be shipped with the unit: the upper tank support members of the structural walls which form a cradle to support the tank, the funnel shaped water tank with optional sloping cover and, if desired, pipes for heating water and/or solar panels or photovoltaic roofing tiles and batteries. In lieu of solar panels, an ethanol powered generator may be shipped to provide electrical power for the unit or the unit is connected to the local power grid. The basic unit is additionally connected to existing water and sewer lines. A thermal heat pump and a cistern may be installed locally, if desired.

If the structure is to be retrofitted for installation in a residential dwelling in a primitive tropical area with no utilities available, all new structures are built in clusters of 6 to 8 in order to have a common cistern for excess rainwater storage and a common septic or biomass sewer system. A common well for backup water and an ethanol powered generator for backup power may be utilized. Additional items shipped for such structures may include a water storage tank to hold "clean" used water from the sink, basin and shower drains for use to flush the toilet, a water pump to direct water to the overhead tank, and an ultraviolet water purifier with filter to provide safe drinking water to the sink faucet from the rainwater tank. If appropriate and preferred, an alternate composting toilet might be made available for the unit.

In the event that the structure is to be shipped to a primitive location with a temperate-to-cold climate, all of the above partitions, fixtures, cabinets and appliances are appropriate; however, a community heat pump for a cluster of 6 to 8 residential structures may be required for heating/cooling.

It is envisioned that any new USA housing will be built in clusters of 6 to 8, in contemporary designs and, perhaps, of new economical space-age materials. Such housing would greatly aid city planners in their recycling of slum housing and deteriorating commercial areas.

The core can be installed in urban warehouses that have been partitioned into apartment sized areas making almost instant housing. In such an application the core would not be shipped with the rainwater storage tank, its cover or solar panels unless those are to be placed on the building's roof. In the same version the core may be used to convert garages, sheds and barns quickly into living quarters.

The structure's use is not to be limited to residential applications. The unit's basic core may be partitioned to receive four toilets and two wash basins for placement in small structures where public restrooms are required such as in parks, along walking trails and in small shops or offices. In the same version without the cores' upper section, the core may be used to convert old multi-storied office or warehouse buildings into offices.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A modular utility core for shipping in a disassembled state to a building for use and then being assembled therein atop a floor comprising:

a rigid outer cage with outer cage bottom ends;

outer cage mounting fittings on said outer cage bottom ends to fixedly mount said outer cage to a floor;

a utility channel inner cage with inner cage bottom ends, said outer cage surrounding said inner cage, said inner cage including a plurality of vertically aligned bands forming a utility storage space;

a plurality of structural walls connected to and extending radially outwardly from said bands of said inner cage toward and being connected to said outer cage forming rooms including a bathroom between said walls, said outer cage and said inner cage and further including a kitchen with said bathroom and kitchen each including appliances/fixtures located between said outer cage and said inner cage between said walls for controlling flow of fresh water and sewage water;

fresh water conveying conduits within said inner cage and connected to said appliances/fixtures in said bathroom and kitchen;

sewage water conveying conduits within said inner cage and connected to said appliances/fixtures in said bathroom and kitchen;

vent conduits within said inner cage; and electric wiring within said inner cage.

2. The modular utility core of claim 1 wherein:

said outer cage includes a top ring, a bottom ring, middle rings and a plurality of vertical members respectively connected to said top ring, said bottom ring and said middle rings enabling said outer cage to surround said plurality of walls locating said plurality of walls within said outer cage.

3. A modular utility core for shipping in a disassembled state to a building for use and then being assembled therein atop a floor comprising:

a rigid outer cage with outer cage bottom ends;

outer cage mounting fittings on said outer cage bottom ends to fixedly mount said outer cage to a floor;

a utility channel inner cage with inner cage bottom ends, said outer cage surrounding said inner cage;

a plurality of structural walls connected to and extending outwardly from said inner cage toward and being connected to said outer cage forming rooms including a bathroom between said walls, said outer cage and said inner cage and further including a kitchen with said bathroom and kitchen each including appliances/ fixtures located between said outer cage and said inner cage between said walls for controlling flow of fresh water and sewage water;

fresh water conveying conduits within said inner cage and connected to said appliances/fixtures in said bathroom and kitchen;

sewage water conveying conduits within said inner cage and connected to said appliances/fixtures in said bathroom and kitchen;

vent conduits within said inner cage; and electric wiring within said inner cage and wherein:

said inner cage has multiple plates connected together forming a top band, middle bands and a bottom band, said walls include fasteners connecting said plates to said plurality of structural walls.

4. The modular utility core of claim 3 and further comprising:

said plates in each band overlap each other and include a straight main body with inwardly turned ends overlapping inwardly turned ends of adjacent plates, said fasteners extend vertically through said inwardly turned ends.

5. The modular utility core of claim 1 and further comprising:

a top extension extending above said structural walls, said top extension includes a rain-gathering funnel shaped tank facing upwardly and leading downwardly being connected to said fresh water conveying conduit.

6. The modular utility core of claim 4 wherein:

said outer cage includes a top ring, a bottom ring, middle rings and a plurality of vertical members respectively connected to said top ring, said bottom ring and said middle rings enabling said outer cage to surround said plurality of walls locating said plurality of walls within said outer cage, said outer cage includes a middle ring located between said bottom ring and said top ring with said middle ring extending only partially around said outer cage allowing access to said bathroom located inwardly of said outer cage; and, said plates are connected together into a poly-sided structure.

7. The modular utility core of claim 6 and further comprising:

a plurality of doors hingedly mounted to said outer cage between said structural walls to close some of said rooms.

8. The modular utility core of claim 7 wherein:

said rooms include a commode room, a wash basin room, a shower room, and a kitchen with a sink and refrigerator.

9. The modular utility core of claim 8 wherein:

said inner cage is five sided and contained within a twelve inch diameter with said plurality of structural walls numbering five providing five rooms.

10. The modular utility core of claim 5 and further comprising:

upwardly extending tank support members having top edges and bottom edges; and wherein:

said rain gathering funnel shaped tank of said top extension is supported by said upwardly extending tank support members; and wherein:

said structural walls have top frame members and a channel along said top frame members to accept said tank support members along said bottom edges;

said tank support members shaped along the top edges to collectively form a cradle to support said tank; and, said outer cage include vertical members and a top ring secured together, said tank further positioned and stabilized by the vertical members and top ring and individually secured to said members.

11. A modular utility core for shipping in a disassembled state to a building for use and then being assembled therein atop a floor comprising:

a rigid outer cage with outer cage bottom ends mountable to a floor;

a utility channel inner cage located within said outer cage, said inner cage including a plurality of members with overlapping ends, said members are arranged in a plurality of vertically arranged and spaced apart bands;

a plurality of structural walls connected to and extending outwardly from said inner cage toward and being connected to said outer cage forming a plurality of rooms, each of said walls including inner ends with fasteners connected to said members securing said inner cage to said structural walls;

a fresh water conveying conduit within said inner cage; and, a sewage water conveying conduit within said inner cage.

12. The modular utility core of claim 11 wherein:

said fasteners project through said overlapping ends securing said members to said structural walls, said bands form a vertically extending utility space with said fresh water conveying conduit and said sewage water conveying conduit located therein;

said outer cage includes a plurality of vertically extending members and a plurality of horizontally extending rings connected to said vertically extending members; and, said structural walls include outer ends connected to said rings and said vertically extending members at a location where said rings intersect said vertically extending members.

13. The modular utility core of claim 12 wherein:

said rings include a bottom ring mountable to said floor and a top ring; and further comprising:

a plurality of water tank supporting members mounted atop said structural walls and within said top ring; and said vertically extending members, a funnel shaped water tank restingly mounted atop said water tank supporting members opening outwardly from a building to catch rain water.

14. The modular utility core of claim 12 wherein:

said walls extend radially outward from said inner cage to said outer cage forming a plurality of rooms including a bathroom, a kitchen, and a shower room.

15. A construction for forming rooms within a building comprising:

a utility channel inner cage, said inner cage including a plurality of vertically aligned bands forming a utility storage space;

an outer cage; and, a plurality of walls connected to said bands of said inner cage and extending outwardly therefrom, said outer cage includes a plurality of rings and a plurality of vertically extending members connected to said rings with said plurality of walls having outer ends connected to said rings and said members where said rings, members and walls meet.

16. A construction for forming rooms within a building comprising:

a utility channel inner cage:

an outer cage; and, a plurality of walls connected to said inner cage and extending outwardly therefrom, said outer cage includes a plurality of rings and a plurality of vertically extending members connected to said rings with said plurality of walls having outer ends connected to said rings and said members where said rings, members and walls meet, and wherein:

said inner cage includes a plurality of vertically aligned bands connected to said walls which extend radially outwardly therefrom, said bands form a utility storage space.

17. The construction of claim 16 wherein said rooms surround said inner cage and said bands each include a number of plates with said number of plates within each band equal to the number of said rooms surrounding said inner cage.

* * * * *